United States Patent [19]

Hermalahti

[11] 4,324,337

[45] Apr. 13, 1982

[54] ARTICLE SUPPORT RACK

[76] Inventor: Raimo K. Hermalahti, 12 Johnston St., Southport, Queensland, 4215, Australia

[21] Appl. No.: 135,924

[22] Filed: Mar. 31, 1980

[30] Foreign Application Priority Data

Sep. 13, 1978 [AU] Australia ..... PD5922
Sep. 13, 1979 [AU] Australia ..... 50840/79

[51] Int. Cl.[3] ..... A47F 5/08
[52] U.S. Cl. ..... 211/89; 248/316 D
[58] Field of Search ..... 211/89, 45, 48, 51; 248/316 D, 316 F, 316 E, 316 R, 313, 95, 101

[56] References Cited

U.S. PATENT DOCUMENTS 1,290,932 1/1919 Dorhauer ..... 211/89
1,418,014 5/1922 Nordyke ..... 211/89 X
2,002,566 5/1935 Conigrave ..... 211/89
2,036,761 4/1936 Krause ..... 211/89 X
2,178,113 10/1939 Dailey ..... 211/89 X
2,209,953 8/1940 Youngquist ..... 211/89 X
2,590,297 3/1952 Curtis, II ..... 211/89 X

*Primary Examiner*—Ramon S. Britts
*Attorney, Agent, or Firm*—Wegner, Stellman, McCord, Wood & Dalton

[57] ABSTRACT

This invention relates to a support rack for articles such as towels. In one form the support rack is provided with spring latches which are adapted to grip the towel so as to prevent retraction therefrom in a downward direction. However a towel supported at either side by a pair of identical such support racks may be withdrawn by grasping the towel between the members so that the towel disengages sideways from the latches.

8 Claims, 4 Drawing Figures

ARTICLE SUPPORT RACK

BACKGROUND OF THE INVENTION

At present, tea towels and bath towels are normally hung to dry across a horizontal rack so that equal portions hang down either side of the rack. Normally, the person hanging up the towel takes care to ensure that the towel is spread evenly along the rack so as to achieve maximum ventilation for drying purposes. When towels are thus supported people, especially children, who require the use of a towel, simply wipe their hands on the lower portion of the towel hanging from the rack. More often than not, this causes the towel to fall from the rack.

Also, clothes which cannot be draped across a normal coat hanger are often supported in clip-type coat hangers, and to secure clothes to these, the person hanging the clothes must firstly position the clothes correctly and then, holding the clothes with one hand, opens each clip with the other hand to engage the clips separately. The clothes then have to be hung up in the cupboard. This is a tedious operation and it is thus an object of this invention to provide an article support rack which will overcome the above and other disadvantages and which will be reliable and efficient in operation.

It is also an object of this invention to provide an article support rack which will support articles in such manner that removal from the rack cannot be effected by a downward pull, removal only being achieved by grasping the supported article adjacent the rack and moving the article either outwardly or upwardly, so that supported articles will not be inadvertently dislodged in use. Other objects and advantages of the invention will become apparent from the following description.

SUMMARY OF THE INVENTION

With the foregoing and other objects in view, this invention resides broadly in a hanging assembly including: a supporting body having a recess therein; latch means adapted to extend operatively across said recess from one side thereof and movable between an operative position, at which said latch means engages against the opposite side of said recess to close same, and an inoperative position at which said latch means is spaced from said opposite side, and means to urge said latch means to said operative position.

BRIEF DESCRIPTION OF THE DRAWINGS

In order that the invention may be more readily understood and put into practical effect, reference will now be made to the accompanying drawings which illustrate the preferred embodiment of the invention and wherein.

DESCRIPTION OF THE PREFERRED EMBODIMENT

Figure 1:
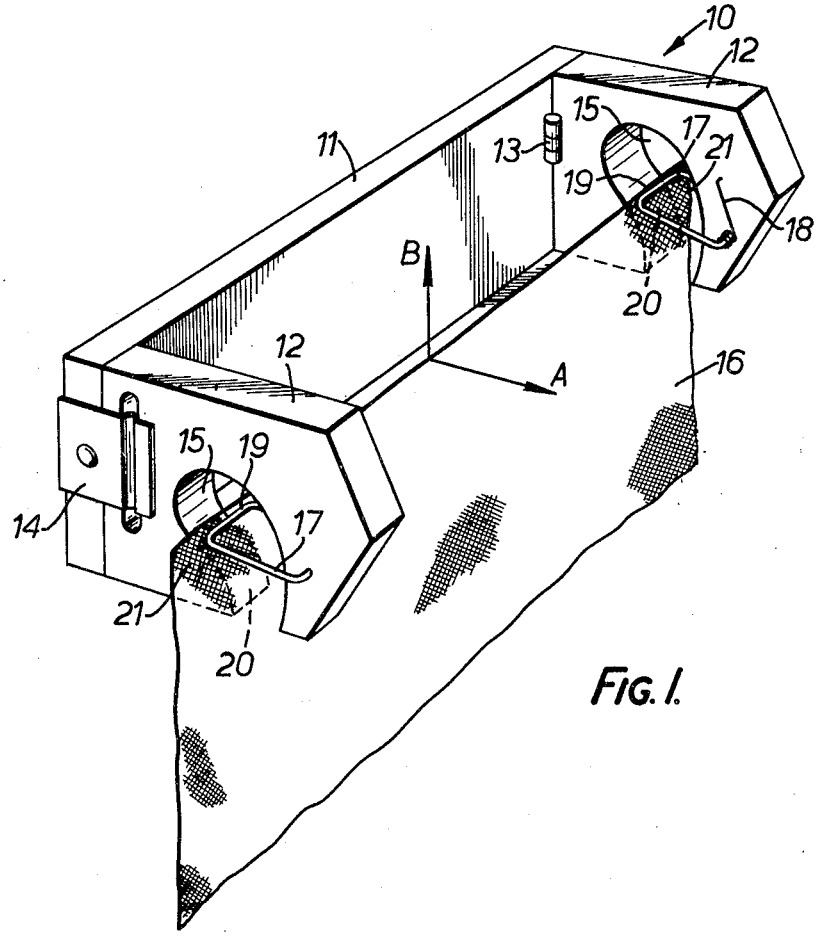
FIG. 1 is a perspective view of an article support rack made in accordance with the present invention.

Referring to the embodiment illustrated in FIG. 1 there is shown an article support rack 10 comprising a backing member 11 to which outwardly extending support arms 12 are connected. In this embodiment, the arms 12 are connected pivotally to the backing member 11 by hinges 13 and are retained in their operative outwardly extending position by spring latch means 14.

Each outwardly extending support arm 12 is provided with an upwardly and rearwardly extending recess 15 into which an article 16 to be supported may be engaged. Associated with the recess 15 is a U-shaped pivotable latch member 17 which is provided with a return spring 18, adapted to urge the remote end 19 of the latch member 17 downwards into engagement with the rearwardly inclined upper face 20 of the recess 15.

In use, the article to be supported, which in this example is a substantially rectangular article, such as a tea towel 16, is simply gripped between the fingers at the opposite upper corners 21 and urged to its outstretched position and moved upwardly into the spaced recesses 15. The upward movement will cause the article 16 to slide between the supporting faces 20 and the latch member 17. For this purpose, each latch member 17 will move springedly away from the face 20 to enable the towel 16 to slide therebetween and the towel 16, when in position, will be retained by the spring-urged latches 17.

In this manner, the outstretched article will be quickly hung neatly and a downward pull on the lower end of the towel 16 will not cause disengagement but will act to increase the force of engagement between the latch members 17 and the upper face 20. Thus, when hung in this attitude the lower free end of the towel 16 may be used for wiping purposes without causing the towel to be disengaged from the rack. When the towel 16 is required to be disengaged from the rack, the user simply grasps the outstretched article by its top centre portion and moves the towel outwardly in direction A or upwardly in direction B. This will cause the opposite upper corners 21 of the towel to slide between the latch member 17 and the face 20 so as to free the towel from the support arms 12.

Figure 2:
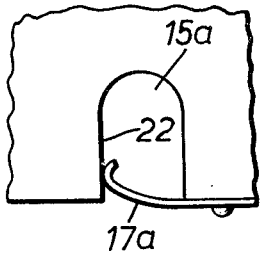
FIG. 2 is a diagrammatic view of an alternate form of latch assembly.

In FIG. 2 there is shown an alternate form of recess 15*a* and spring latch member 17*a*, the latter being simply a spring steel plate fixed rigidly to the underside of the member forming the recess 15*a* and extending upwardly into the recess to engage the opposite side face 22. Alternately, two such latch members could be disposed extending upwards so as to oppose one another.

Figure 3:
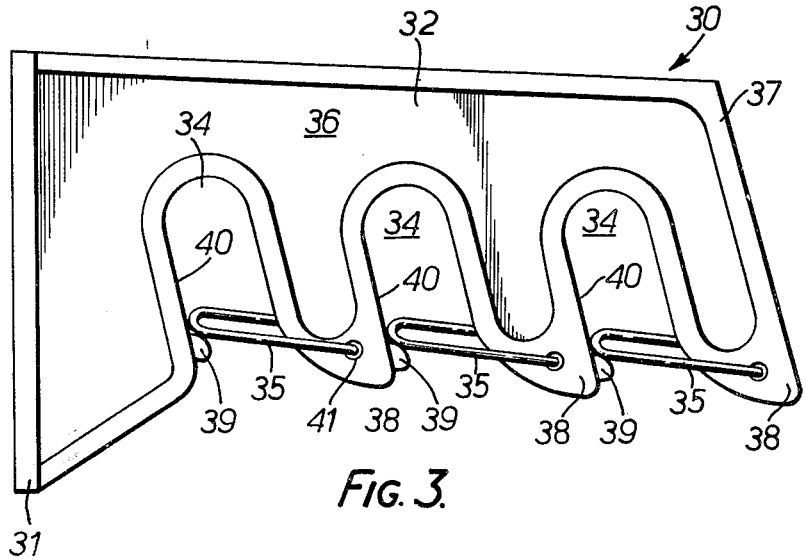
FIG. 3 is a side view of a preferred form of hanging assembly according to this invention.
Figure 4:
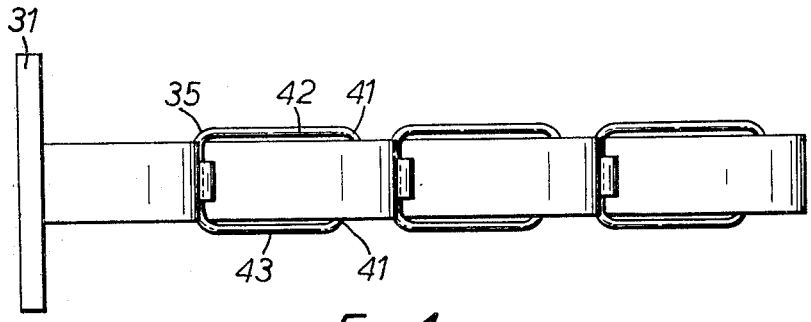
FIG. 4 is an inverted plan view of the embodiment illustrated in FIG. 3.

In the embodiment illustrated in FIGS. 3 and 4, the invention is utilised as a hanging assembly 30 which may be used singly or in combination as desired. As shown, each assembly 30 is in the form of a bracket provided with a mounting flange 31 so that it may be secured to a suitable upright supporting surface and a body portion 32 which is provided with three upwardly and rearwardly extending recesses 34 formed between adjacent downwardly extending finger portions 34*a* and associated closure latches 35. This embodiment is designed for manufacture in plastic by a moulding process and thus the body portion 32 includes a web part 36 and a peripheral flange 37 which extends therearound for strength purposes and to provide lower mounting portions 38 for the spring latches 35 which are preferably made from stainless steel.

Each spring latch 35 is urged to its closed position against a stop 39 projecting outwardly from the respective rearwardly inclined supporting face 40 of each recess 34 so as to enhance the clamping effect and to enable the hanging assembly 30 to be utilised for supporting relatively large articles such as sheets and/or blankets and the like. For this purpose, it will be found that the assembly 30 of the present invention is convenient in use to assist an individual in the folding of large articles such as sheets, as one end of the sheet can be supported in the latch and held in its various folded configurations during the folding process.

As shown in the drawings, the spring latches 35 are formed as substantially U-shaped members the free ends of which are bent inwards to engage in respective apertures 41 in the lower mounting portions 38 and it will be seen that the apertures 41 at opposite sides of the lower mounting portions 38 are offset in both the longitudinal direction and the vertical direction and that one leg 42 of the spring latch 35 is shorter than the other leg 43. This eccentric arrangement of the mounting apertures cause the latches to be stressed when moved away from the abutment stops 39 and thus provides the positive clamping action thereagainst.

I claim:

1. A hanging assembly including a supporting body having a recess therein; latch means pivotally connected to said supporting body at a pair of spaced pivot points at one side of said recess whereby said latch means is pivotable between an operative position at which said latch means engages against the opposite side of said recess to close same, and an inoperative position at which said latch means is spaced from said opposite side and characterized in that one said pivot point is eccentrically disposed relative to the other said pivot point whereby said latch means is urged away from said inoperative position to said operative position.

2. A hanging assembly according to claim 1, wherein each said pivot point is defined by a respective spigot engaging with a respective aperture.

3. A hanging assembly according to claim 2, wherein the respective said apertures are disposed eccentrically on opposite sides of said supporting body.

4. A hanging assembly according to claim 3, wherein said latch means comprises a U-shaped member, the free ends of which are turned inwardly to define respective said spigots for engagement with respective said apertures, said latch member being resiliently deformed on pivotal movement thereof towards said inoperative position whereby to be urged away from said inoperative position towards said operative position.

5. A hanging assembly according to claim 4, wherein one said aperture is offset inwardly and upwardly relative to the other said aperture.

6. A hanging assembly according to claim 5, wherein one leg of said U-shaped latch member is shorter than the other leg thereof.

7. A hanging assembly according to claim 6, wherein said latch member engages in its operative position with a stop member on the opposite side of said recess.

8. A hanging assembly according to claim 7, wherein said supporting body includes a mounting flange adapted for connection to an upright supporting surface and a plurality of spaced apart downwardly extending finger portions, each adjacent pair of said finger portions forming therebetween a respective said recess and there being provided respective said latch members pivotally connected to the lower end of each said finger portion to extend operatively across the respective said recess when disposed in said operative position.

* * * * *